US008403023B1

(12) United States Patent
Mullet et al.

(10) Patent No.: US 8,403,023 B1
(45) Date of Patent: Mar. 26, 2013

(54) SELF RESETTING COVER SYSTEM AND METHOD

(75) Inventors: Willis Jay Mullet, Gulf Breeze, FL (US); Richard Scott Hand, Pace, FL (US)

(73) Assignee: Homerun Holdings Corp., Pensacola, FL (US)

( * ) Notice: Subject to any disclaimer, the term of this patent is extended or adjusted under 35 U.S.C. 154(b) by 25 days.

(21) Appl. No.: 12/315,542

(22) Filed: Dec. 4, 2008

(51) Int. Cl.
*E06B 9/56* (2006.01)

(52) U.S. Cl. ..... 160/273.1; 160/26

(58) Field of Classification Search ..... 160/26, 160/273.1, 84.06, 270, 271, 272
See application file for complete search history.

(56) References Cited

U.S. PATENT DOCUMENTS

| | | | | | |
|---|---|---|---|---|---|
| 1,198,456 | A | * | 9/1916 | Knapp | 160/273.1 |
| 1,764,880 | A | * | 6/1930 | Nelson | 160/267.1 |
| 4,480,676 | A | * | 11/1984 | Solomon | 160/272 |
| 4,586,552 | A | * | 5/1986 | Labelle | 160/133 |
| 4,909,299 | A | | 3/1990 | Bussert | |
| 4,934,437 | A | * | 6/1990 | Kraeutler | 160/84.02 |
| 5,010,944 | A | | 4/1991 | Bussert | |
| 5,058,651 | A | * | 10/1991 | Ashley et al. | 160/271 |
| 5,275,221 | A | | 1/1994 | Doehlemann | |
| 5,379,823 | A | * | 1/1995 | Kraeutler | 160/271 |
| 5,392,835 | A | | 2/1995 | Wildt | |
| 5,445,209 | A | * | 8/1995 | Lichy | 160/273.1 |
| 5,579,820 | A | | 12/1996 | LePage et al. | |
| 5,638,883 | A | | 6/1997 | Schulte | |
| 5,964,270 | A | | 10/1999 | Kirkey et al. | |
| 5,964,271 | A | * | 10/1999 | Lapointe | 160/273.1 |
| 5,996,669 | A | | 12/1999 | Miller | |
| 6,296,039 | B1 | | 10/2001 | Mullet et al. | |
| 6,341,639 | B1 | | 1/2002 | Mullet et al. | |
| 6,394,173 | B2 | * | 5/2002 | Enssle | 160/273.1 |
| 6,431,250 | B2 | | 8/2002 | Mullet et al. | |
| 6,523,596 | B1 | | 2/2003 | Mullet et al. | |
| 6,851,464 | B2 | | 2/2005 | Hudoba et al. | |
| 6,886,300 | B2 | | 5/2005 | Hudoba et al. | |
| 6,959,748 | B2 | | 11/2005 | Hudoba | |

* cited by examiner

*Primary Examiner* — David Purol
(74) *Attorney, Agent, or Firm* — J. Nevin Shaffer, Jr.

(57) ABSTRACT

A self resetting cover system includes two oppositely positioned guide rails with a chamber. A movable cover with a first end, a second end, a first edge and a second edge is provided where the first edge is connected with the chamber of one of the two oppositely positioned guide rails and the second edge is connected with the chamber of another of the two oppositely positioned guide rails. The first edge and the second edge include at least some portion that is enlarged and the enlarged portion of the first edge and the second edge is a deformable, resilient edge material. The enlarged area deforms upon impact to the movable cover such that the first edge and the second edge are not movable within the chamber and the enlarged area then resets to an original form after impact to the movable cover such that the first edge and the second edge are movable within the chamber. A cover roll is connected with the first end.

12 Claims, 6 Drawing Sheets

SELF RESETTING COVER SYSTEM AND METHOD

FIELD OF THE INVENTION

This invention relates to a self resetting cover system and method. In particular, in accordance with one embodiment, the invention relates to a self resetting cover system including two oppositely positioned guide rails with a chamber. A movable cover with a first end, a second end, a first edge and a second edge is provided where the first edge is connected with the chamber of one of the two oppositely positioned guide rails and the second edge is connected with the chamber of another of the two oppositely positioned guide rails. The first edge and the second edge include at least some portion that is enlarged and the enlarged portion of the first edge and the second edge is a deformable, resilient edge material. The enlarged area deforms upon impact to the movable cover such that the first edge and the second edge are not movable within the chamber and the enlarged area then resets to an original form after impact to the movable cover such that the first edge and the second edge are movable within the chamber. A cover roll is connected with the first end.

BACKGROUND OF THE INVENTION

A problem exists with efforts to cover openings, such as openings in structures in the nature of windows and the like, by way of example only and not by limitation. When it is desired to protect openings from wind, rain, wind blown debris and such, many difficulties present themselves to those of skill in the art. A major problem is how to provide a cover that can protect the opening but that does not permanently obstruct the opening. Thus, most of the efforts to provide covers for openings are directed to covers that are movable. Applicants themselves have developed movable systems as set forth in Mullet et al., U.S. Pat. Nos. 6,523,596, 6,431,250, 6,341,639, and 6,296,039. These systems are excellent at providing protection for openings against the hazards described above. Nonetheless, problems remain. One of the problems is how to replace the cover in condition for reuse after a storm event. Another problem is how to provide a protecting cover that is simple to use and as inexpensive and unobtrusive as possible. Another problem is how to provide a cover that is useful on the inside as well as the outside of an opening while at the same time remaining functional when exposed to the elements. A further problem is how to provide a cover that absorbs impacts and then is easily reset to absorb another impact without user or operational intervention.

Hudoba et al. discloses several variations of storm protection devices in U.S. Pat. Nos. 6,959,748, 6,886,300, and 6,851,464. These devices require complex, interlocked frames and bars and locking devices to hold a protective cover in place. Likewise, Doehlemann, U.S. Pat. No. 5,275,221, discloses a complex system including a guide rod for a fabric cover requiring sliding pins and tracks. Similarly complex roll up and roll down devices, such as shutters and doors, are disclosed in Miller, U.S. Pat. No. 5,996,669, Kirkey et al., U.S. Pat. No. 5,964,270, Schulte, U.S. Pat. No. 5,638,883, LePage et al., U.S. Pat. No. 5,579,820, and Wildt, U.S. Pat. No. 5,392,835.

Bussert, U.S. Pat. Nos. 5,010,944 and 4,909,299, discloses a rigid but bendable material and a system for suspending the material.

Thus it can be appreciated that the problems discussed above remain and result in the need, among others, for an opening cover system that is simple, easy to use and unobtrusive. It, therefore, is an object of this invention to provide a cover system for an opening that protects an opening from wind, rain, wind blown debris and the like, that is mechanically simple, that does not require resetting between impact events and which is unobtrusive. It is a further object to provide a cover system that is easy to install, repair, remove and replace and that is relatively inexpensive.

SUMMARY OF THE INVENTION

Accordingly, the self resetting cover system of the present invention, according to one embodiment, includes two oppositely positioned guide rails, each guide rail with a chamber. A movable cover with a first end, a second end, a first edge and a second edge is provided where the first edge is connected with the chamber of one of the two oppositely positioned guide rails and the second edge is connected with the chamber of another of the two oppositely positioned guide rails. Further, the first edge and the second edge include at least some portion that is enlarged and the enlarged portion of the first edge and the second edge is a deformable, resilient edge material. The enlarged area deforms upon impact to the movable cover such that the first edge and the second edge are not movable within the chamber. Further, the resilient enlarged area resets to an original form after impact to the movable cover such that the first edge and the second edge are movable within the chamber. A cover roll is connected with the first end.

As used herein, the term "cover" is used with its common, ordinary meaning to include a protective material made of plastic, vinyl, fabric and the like so long as the cover is a strong, impact resistant material that is still flexible enough to be rolled on to and off of a cover roll. Any such flexible material now known or hereafter developed is suitable.

Likewise, the terms "deformable" and "resilient" are used with their common meaning to include material that has a resting shape and that may be deformed to another shape and then returns to its original shape. Rubber, some plastics and the like as are known or hereafter developed are suitable.

Further, it should be understood that the self resetting cover system of the present invention is most particularly directed to covers for openings in structures such as glass windows and doors, for example only and not by way of limitation.

According to other aspects of the invention, a bottom bar is connected with the second end. In another aspect, a header is connected with the cover roll.

In further aspects, the chamber has a first chamber connected with a second chamber. In one aspect, the first chamber is smaller than the second chamber. In another aspect, the enlarged portion of the first edge and the second edge is much smaller than the second chamber and just slightly smaller than the first chamber. Certainly the terms "smaller" and "larger" are used herein with their common meaning. Likewise, "much smaller" and "just lightly smaller" are comparative terms easily understood given their common meaning and the illustrations herein. As the figures clearly illustrate, the enlarged portion when in the second chamber is not confined or even nearly confined within the large space of the second chamber. On the other hand, as again clearly shown in the figures, the enlarged portion is very nearly the same size as the first chamber. Thus any expansion of the enlarged portion within the smaller first chamber causes the enlarged portion to bind against the confines of the smaller first chamber.

In another aspect, the first chamber includes an opening through which the movable cover extends and the opening is smaller than the enlarged portion of the first edge and the enlarged portion of the second edge. In a further aspect, the enlarged portion is not restricted from vertical or horizontal motion within the second chamber.

According to another embodiment of the invention, a self resetting cover system includes a header with a cover storage roll connected with the header. Two oppositely positioned side guide rails with a chamber are provided. A movable cover is provided with a first end connected with the cover storage roll, a second end, a first edge and a second edge. The first edge and the second edge include at least some portion that is enlarged and the first edge is connected with the chamber of one of the two oppositely positioned side guide rails and the second edge is connected with the chamber of another of the two oppositely positioned guide rails. Further, the enlarged portion of the first edge and the enlarged portion of the second edge is a deformable, resilient edge material and the enlarged area deforms upon impact to the movable cover such that the first edge and the second edge are not movable within the chamber. After impact, the enlarged area resets to an original form such that the first edge and the second edge are movable within the chamber. A bottom bar is connected with the second end of the cover.

In another aspect of the invention, the chamber has a first chamber connected with a second chamber. In a further aspect, the first chamber is smaller than the second chamber. In another aspect, the enlarged portion of the first edge and the enlarged portion of the second edge is much smaller than the second chamber and just slightly smaller than the first chamber. In one aspect, the first chamber includes an opening through which the movable cover extends and the opening is smaller than the enlarged portion of the first edge and the second edge. In another aspect, the enlarged portion is not restricted from vertical or horizontal motion within the second chamber.

According to another embodiment of the invention, a self resetting structure opening cover method includes the steps of: providing two oppositely positioned guide rails with a chamber, and with a movable cover with a first end, a second end, a first edge and a second edge where the first edge is connected with the chamber of one of the two oppositely positioned guide rails and the second edge is connected with the chamber of another of the two oppositely positioned guide rails and where the first edge and the second edge include at least some portion that is enlarged and with a cover roll connected with the first end and where the enlarged portion of the first edge and the second edge is a deformable, resilient edge material and where the enlarged area deforms upon impact to the movable cover such that the first edge and the second edge are not movable within the chamber and where the enlarged area resets to an original form after impact to the movable cover such that the first edge and the second edge are movable within the chamber; and connecting the two oppositely positioned guide rails in a structure opening such that extension of the cover covers the structure opening.

In another aspect, the chamber includes an opening through which the movable cover extends and the opening is smaller than the enlarged portion of the first edge and the second edge. In one aspect, the structure opening includes an inside and an outside and a location for locating the guide rails is selected from a group consisting of: the inside of the structure opening and the outside of the structure opening. In another aspect, the chamber has a first chamber connected with a second chamber and the first chamber is smaller than the second chamber. In one aspect, the enlarged portion of the first edge and the second edge is much smaller than the second chamber and just slightly smaller than the first chamber. In another aspect, the enlarged portion is not restricted from vertical or horizontal motion within the second chamber.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
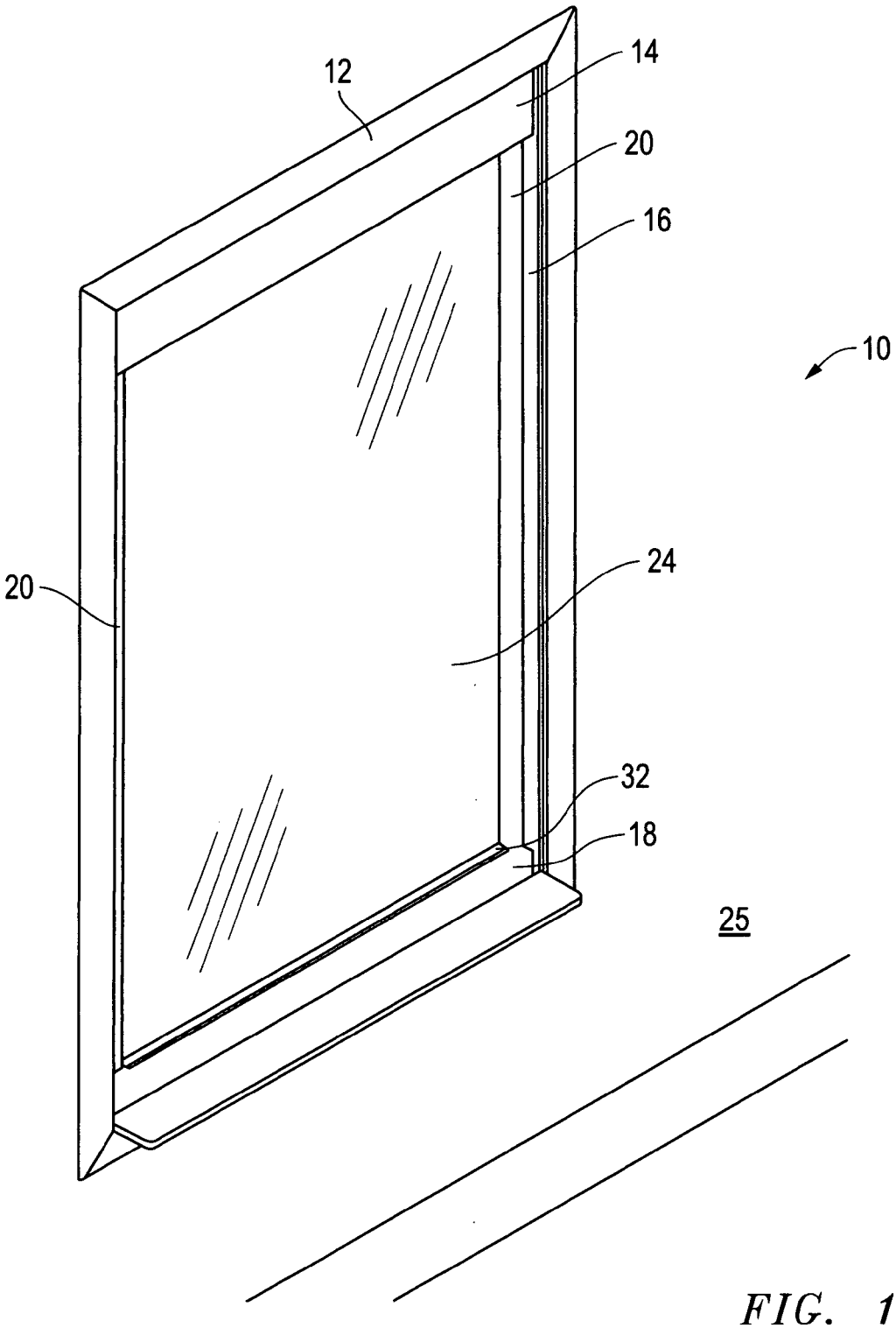
FIG. 1 is a perspective view of a double hung window, from the inside of a structure, including the self resetting cover system of the present invention shown in the lowered position.
Figure 2:
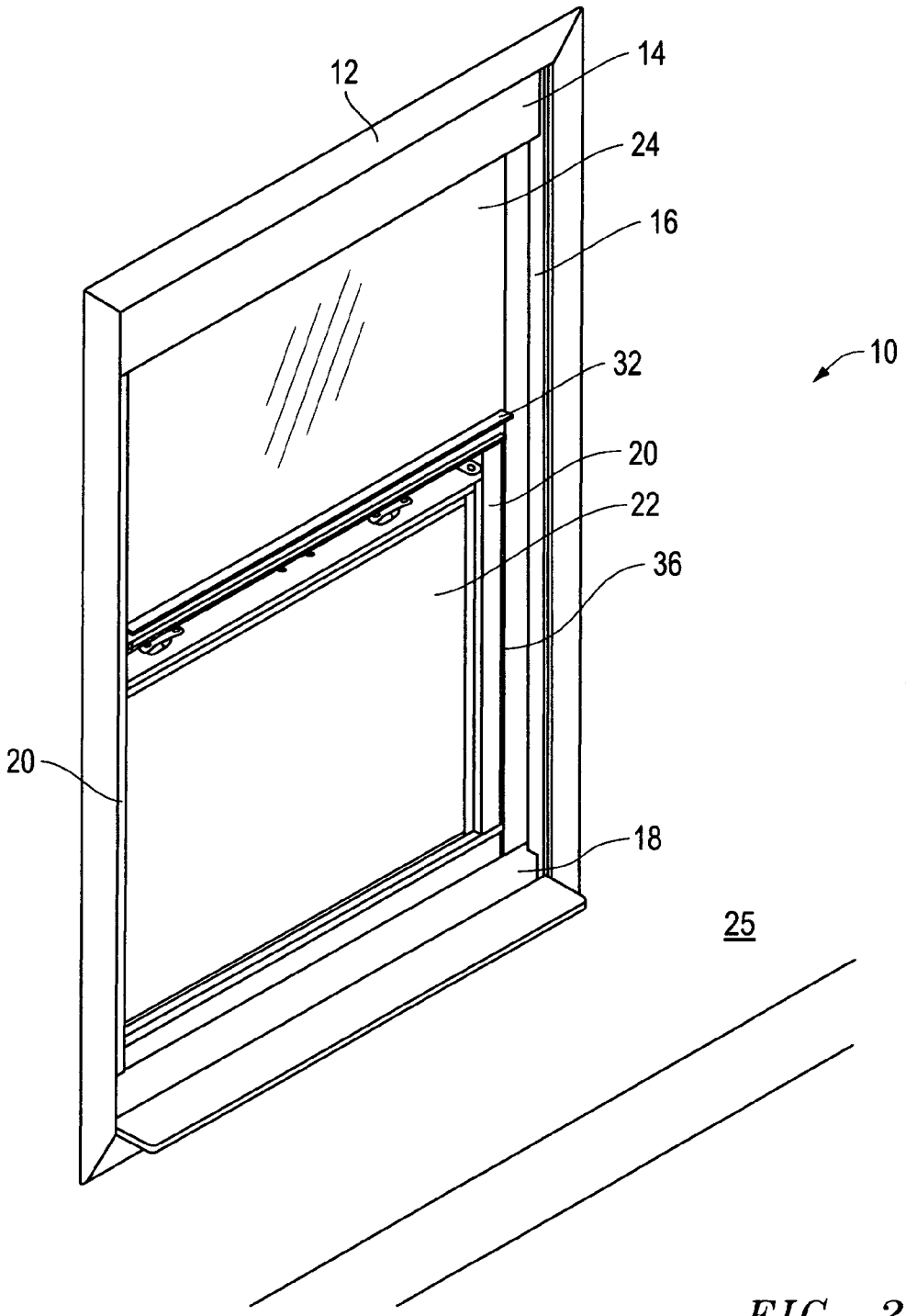
FIG. 2 is a perspective view of the invention of FIG. 1 with the protective cover half way deployed.

The preferred embodiment of the present invention is illustrated by way of example in FIGS. 1 through 6. With specific reference to FIGS. 1 and 2, the self resetting cover system 10 of the present invention according to one embodiment is shown connected with a common double hung window 12. Again, as will be more completely appreciated by way of further description and discussion hereafter, Applicants' self resetting cover system 10 is suitable for use with any opening in a structure, such as a commercial or residential structure for example only. The figures herein are representative only but show the invention in use with window openings and windows in particular. Double hung window 12 includes header 14, two vertical frames 16, sill 18 and two separate window frames 20 with glass 22. FIG. 1 shows the self resetting cover system 10 in the lowered position and thus not concealed within header 14. In the raised position, double hung window 12 is totally unobstructed and open. FIG. 2 shows the self resetting cover system 10 shown in the partially lowered and/or partially deployed position with cover 24 partially lowered toward the sill 18 and partially covering the window 12. When fully lowered, as in FIG. 1, the window opening is fully covered and self resetting cover system fully prevents any debris from entering into the structure. In this regard, it should be noted that FIGS. 1 and 2 illustrate the invention deployed on the inside of a structure 25. As can be appreciated, Applicants' invention is suitable for use on both the inside and the outside of a structure 25.

Figure 3:
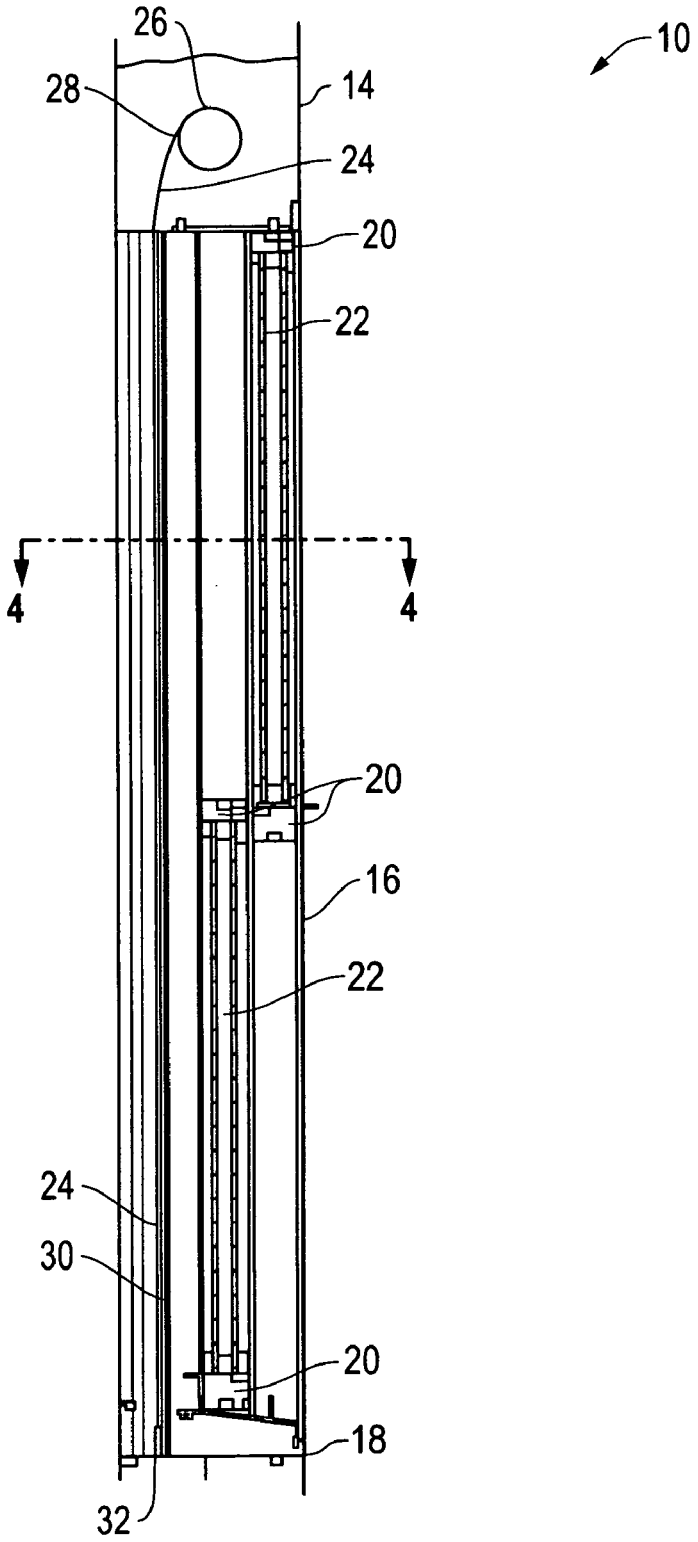
FIG. 3 is a side section view of FIG. 1 showing the present invention deployed.
Figure 4:
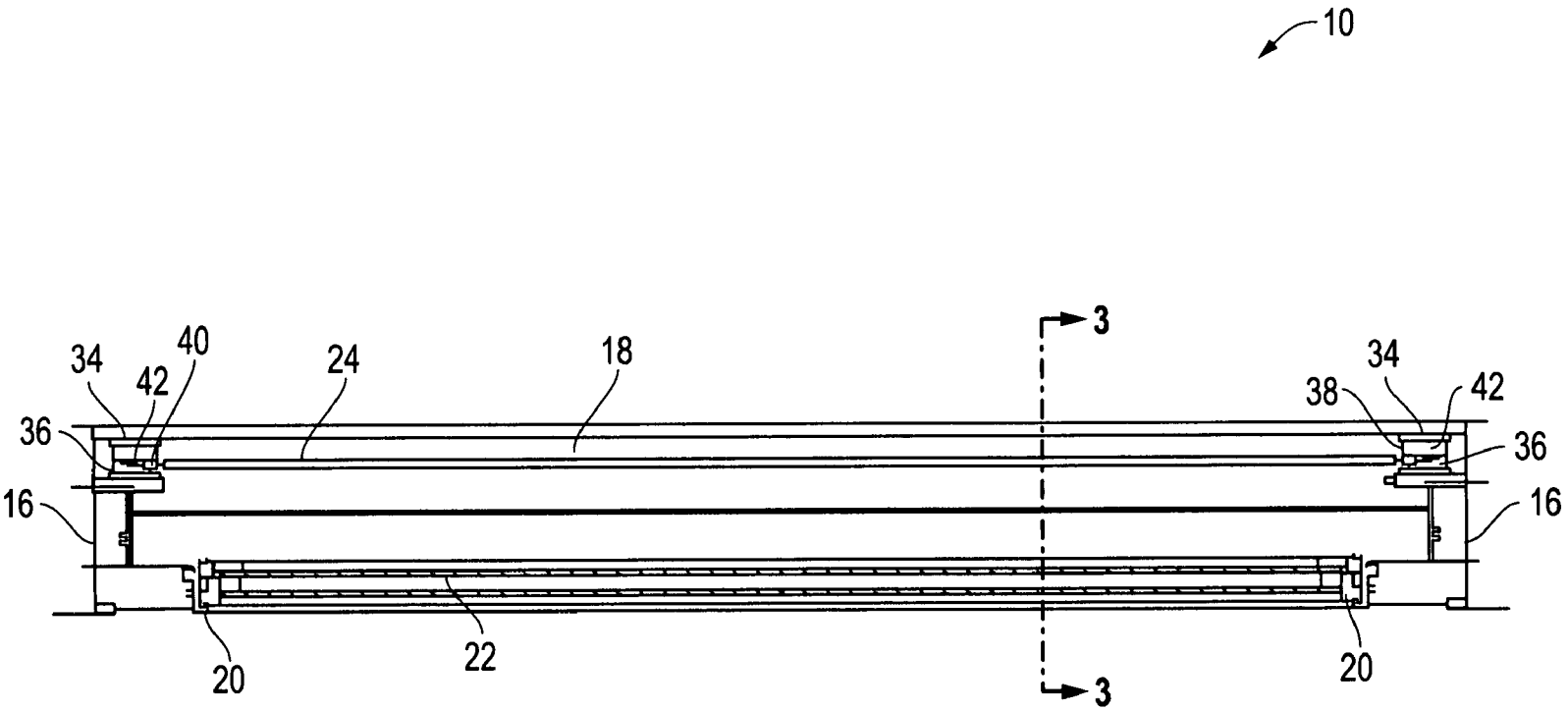
FIG. 4 is a top section view FIG. 3 taken along lines 4-4.

Referring now to FIGS. 3 and 4, side section view FIG. 3 shows more details of the self resetting cover system 10 including cover roll 26. Cover roll 26 is connected with cover 24 at a first end 28 of cover 24. Cover 24 also includes a second end 30. Preferably second end 30 is connected with a bottom bar 32. Bottom bar 32 adds a rigid edge for contact with sill 18 and assists in sealing that edge against wind, water and debris.

FIG. 4 illustrates still other features of the invention including chamber 34 in two oppositely positioned guide rails 36. Cover 24 includes two side edges, side edge 38 and side edge 40. Side edges 38 and 40 include an enlarged portion 42 (more clearly shown in FIGS. 5 and 6). Enlarged portion 42 is made of any deformable, resilient material, as discussed above and as now known or hereafter developed. Applicants have determined that enlarged portion 42 may be made by folding over and securing a portion of the cover 24 to itself. Enlarged portion 42 may also be made by securing a separate strip of deformable, resilient material to the cover 24 such as by gluing or heat sealing or the like.

Figure 5:
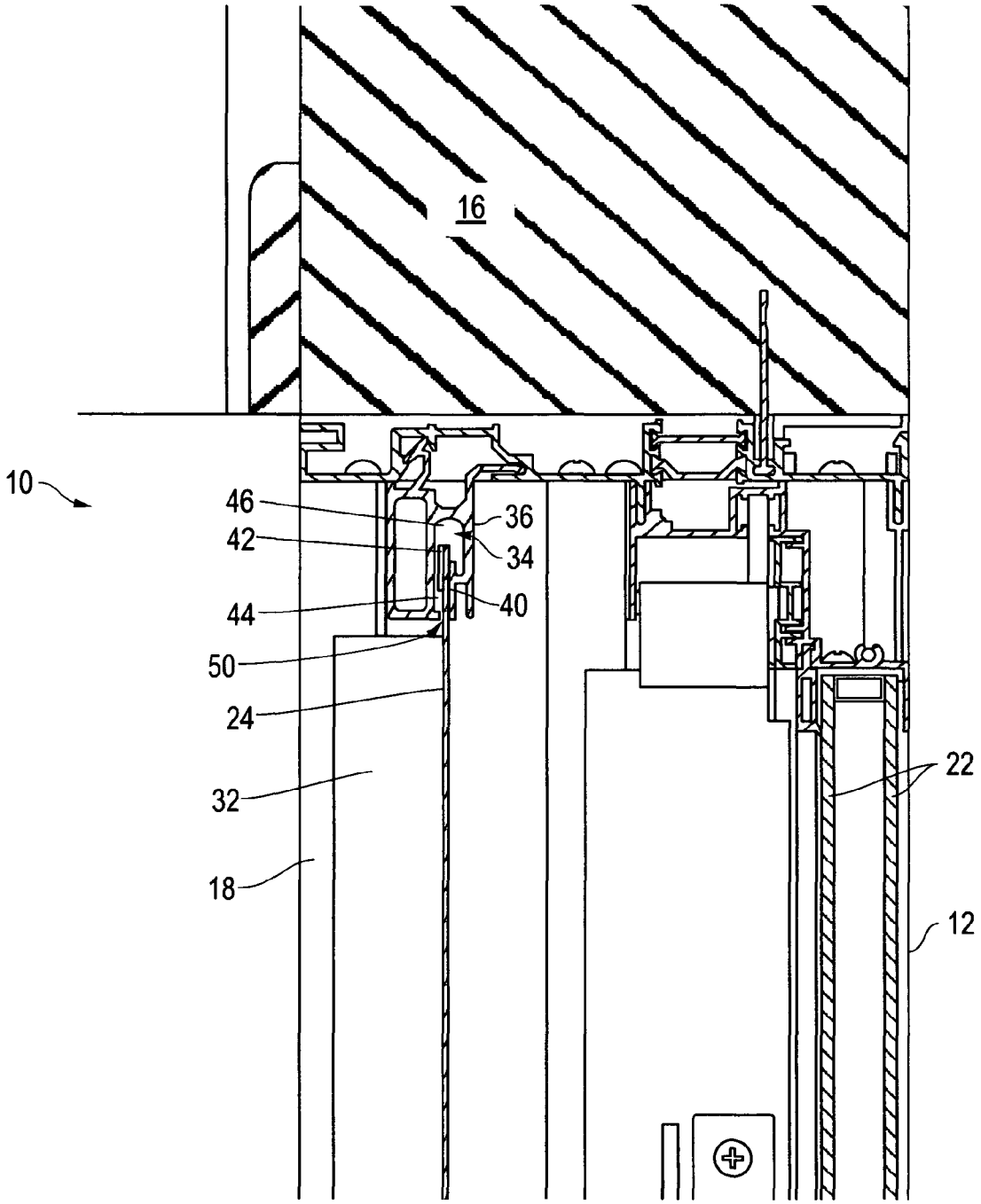
FIG. 5 is an enlarged partial section view showing the cover of the present invention free to move.
Figure 6:
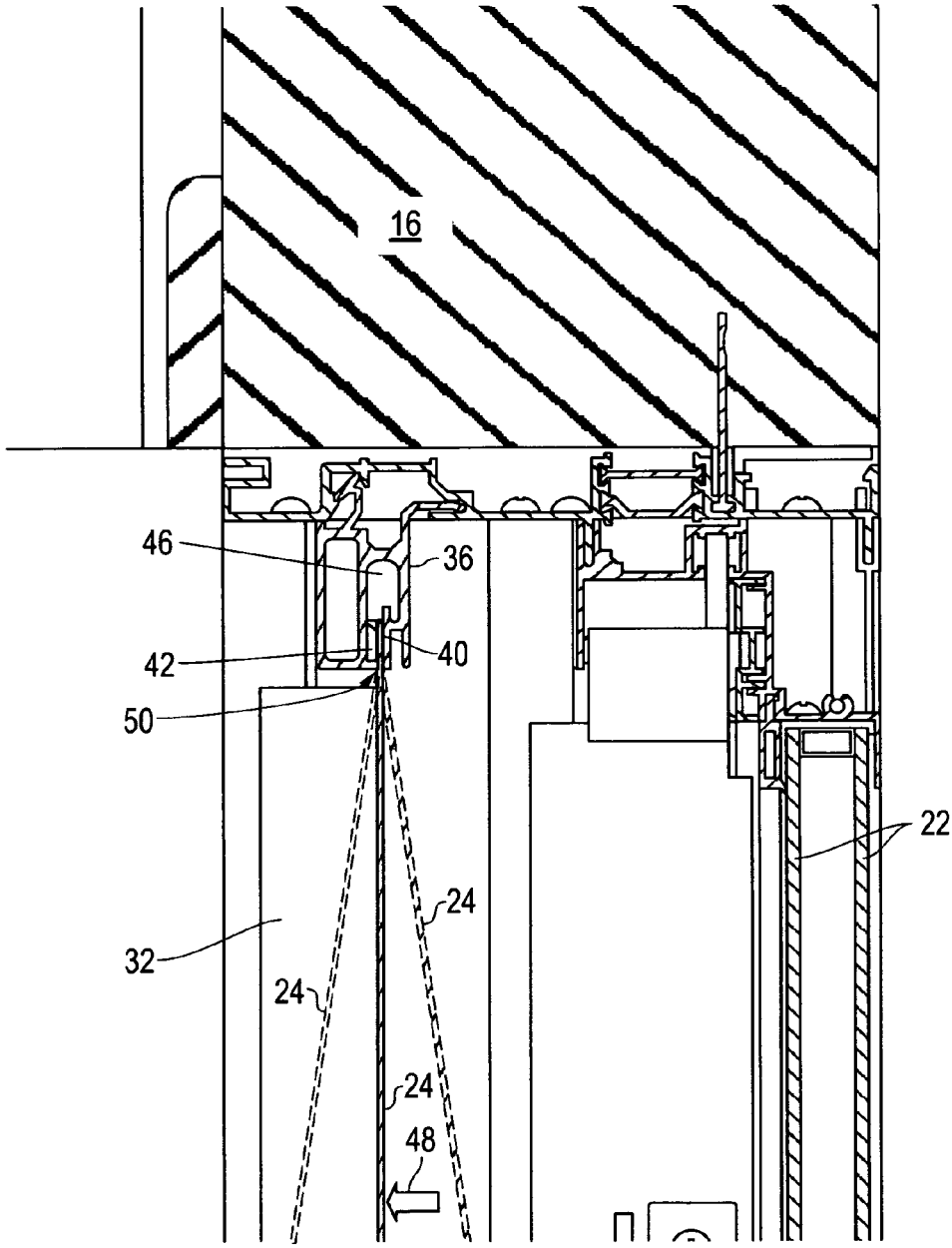
FIG. 6 is an enlarged partial section view showing the cover of the present invention reacting to impact on the cover.

Referring to FIGS. 5 and 6, FIG. 5 is an enlarged view of one side of the self resetting cover system 10 is shown with cover 24 in a lowered and "pre-impact" position. In this position the cover 24 covers the window 12, or any opening with which it is used, completely. Further, chamber 34 is illustrated in a preferred embodiment to include a first section 44 and a second section 46. Second section 46 is "larger" than smaller first section 44 as shown. By "larger", again, it is meant that the second section 46 has a bigger diameter and bigger area than smaller first section 44 (as illustrated) such that enlarged portion 42 of side edge 40 (as well as of side edge 38 on the opposite side of cover 24, not shown) is free to move without restriction up and down and back and forth or vertically and horizontally within second section 46. On the other hand, smaller first section 44 is only slightly larger than enlarged portion 42 of side edge 40 or 38, also as illustrated. In its resting or "pre-impact" position, enlarged portion 42 may be partially within first section 44 and second section 46 as shown. This still allows a high degree of freedom for movement of cover 24 but reduces the distance of travel of cover 24 within first section 44 during an impact event as described next.

Referring now to FIG. 6, Applicants' self resetting cover system 10 is shown functioning during the instant of impact on cover 24. The impact on cover 24 is shown in the form of direction arrow 48. The impact on cover 24 may be caused by wind, water, or debris or a combination of these or other things breaking the glass 22 of window 12. Importantly, when impacted, cover 24 is forced in the direction of direction arrow 48 to the position shown in dotted lines but is cushioned by means of the operation of enlarged portion 42. Again, enlarged portion 42 is made of a deformable, resilient material. Because enlarged portion 42 is larger than the opening 50 in first section 44 of chamber 34 it is retained within first section 44. While being retained within first section 44 it compresses or deforms and thus expands somewhat as shown. Again, these features together cause enlarged portion 42 to deform as cover 24 reacts to the impact. That is, enlarged portion 42 deforms and expands as it is pulled against first section 44 at opening 50. This cushions the impact and, at the same time, the expansion of the enlarged portion 42 fixes or secures side edge 40 (and 38) in place and prevents them from moving vertically or horizontally within guide rail 36. Once the impact is past, enlarged portion 42 expands and resumes its original resting form as shown in FIG. 5. In this position, side edges 38 and 40 are free to move within guide rails 36 as discussed above. Thus, Applicants' self resetting cover system 10 resets itself without need of mechanical or human intervention. As used herein, the term "resets" is used in its common manner to identify a return to a starting position as just described.

FIG. 6 also illustrates the flexible sealing nature of self resetting cover system 10 in that in the case window 22 is broken and debris impacts cover 24 and moves it in the direction of direction arrow 48, the system also works in the opposite direction from direction arrow 48. As shown in FIG. 6, should impact be received on the side opposite from window 22 the system works exactly the same.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A self resetting cover system comprising:

a. two oppositely positioned guide rails each with a chamber wherein said chamber has a first chamber connected with a second chamber, wherein the first chamber is smaller than the second chamber, and wherein said first chamber includes an opening smaller than said first chamber;

b. a movable cover with a first end, a second end, a first edge and a second edge wherein said movable cover extends through said opening of said first chamber in each guide rail and wherein the first edge is connected with the chambers of one of the two oppositely positioned guide rails and the second edge is connected with the chambers of another of the two oppositely positioned guide rails and wherein said first edge and the second edge include at least some portion that is enlarged and wherein the enlarged portion of the first edge and the second edge is very nearly the same size as the first chamber and wherein said enlarged portion is a deformable, resilient edge material and wherein said opening in said first chamber is smaller than the enlarged portion of said first edge and said second edge such that said enlarged portion can not pass through said opening and wherein, upon impact to the movable cover, said enlarged portion catches on said first chamber near said opening and deforms such that said first edge and said second edge contact said first chamber and are not movable and are retained within said first chamber and wherein, after impact to the movable cover, said enlarged portion resets to an original form such that said first edge and said second edge are again movable within said chamber; and c. a cover roll connected with the first end.

2. The apparatus of claim 1 further including a bottom bar connected with the second end.

3. The apparatus of claim 1 further including a header connected with the cover roll.

4. The apparatus of claim 1, wherein said enlarged portion of said first edge and said second edge is much smaller than the second chamber and just slightly smaller than the first chamber.

5. The apparatus of claim 1 wherein said enlarged portion is not restricted from vertical or horizontal motion within said second chamber.

6. A self resetting cover system comprising:

a. a header;

b. a cover storage roll connected with the header;

c. two oppositely positioned side guide rails each with a chamber wherein said chamber has a first chamber connected with a second chamber, wherein the first chamber is smaller than the second chamber, and wherein said first chamber includes an opening smaller than said first chamber;

d. a movable cover with a first end connected with the cover storage roll, a second end, a first edge and a second edge wherein said first edge and said second edge of said movable cover extend through said opening of said first chamber in each guide rail and wherein said first edge and the second edge include at least some portion that is enlarged and wherein the first edge is connected with the chambers of one of the two oppositely positioned side guide rails and the second edge is connected with the chambers of another of the two oppositely positioned guide rails and wherein the enlarged portion of the first edge and the enlarged portion of the second edge is very nearly the same size as the first chamber and wherein said enlarged portion is a deformable, resilient edge material and wherein upon impact to said movable cover said enlarged portion catches on said first chamber near said opening and deforms such that said first edge and said second edge are not movable and are retained within said chamber and wherein said enlarged portion resets to an original form after impact to the movable cover such that said first edge and said second edge are movable within said chamber; and e. a bottom bar connected with the second end of the cover.

7. The apparatus of claim 6 wherein said enlarged portion of said first edge and said second edge is much smaller than the second chamber and just slightly smaller than the first chamber.

8. The apparatus of claim 6 wherein said enlarged portion is not restricted from vertical or horizontal motion within said second chamber.

9. A self resetting structure opening cover method comprising:

a. providing two oppositely positioned guide rails each with a chamber wherein said chamber has a first chamber connected with a second chamber, wherein the first chamber is smaller than the second chamber, and wherein said first chamber includes an opening smaller than said first chamber, and with a movable cover with a first end, a second end, a first edge and a second edge wherein said movable cover extends through said opening of said first chamber in each guide rail and wherein the first edge is connected with the chambers of one of the two oppositely positioned guide rails and the second edge is connected with the chambers of another of the two oppositely positioned guide rails and wherein said first edge and the second edge include at least some portion that is enlarged and with a cover roll connected with the first end and wherein the enlarged portion of the first edge and the enlarged portion of the second edge is very nearly the same size as the first chamber and wherein said enlarged portion is a deformable, resilient edge material and wherein said enlarged portion catches on said first chamber near said opening and deforms upon impact to the movable cover and contact with said first chamber near said opening such that said first edge and said second edge contact said first chamber and are not movable and are retained within said chamber and wherein said enlarged portion resets to an original form after impact to the movable cover such that said first edge and said second edge are again movable within said chamber; and b. connecting the two oppositely positioned guide rails in a structure opening such that extension of the cover covers the structure opening.

10. The method of claim 9 wherein said structure opening includes an inside and an outside and a location for locating the guide rails is selected from a group consisting of the inside of the structure opening and the outside of the structure opening.

11. The method of claim 9 wherein said enlarged portion of said first edge and said second edge is much smaller than the second chamber and just slightly smaller than the first chamber.

12. The method of claim 9 wherein said enlarged portion is not restricted from vertical or horizontal motion within said second chamber.

* * * * *